United States Patent [19]

Lee

[11] Patent Number: 4,828,530

[45] Date of Patent: May 9, 1989

[54] APPARATUS FOR ACTIVATING DOLL'S LIMBS

[76] Inventor: Yeong R. Lee, P.O. Box 10780, Taipei 10099, Taiwan

[21] Appl. No.: 102,734

[22] Filed: Sep. 30, 1987

[51] Int. Cl.[4] ..... A63H 13/00; A63H 3/20; G09F 19/08

[52] U.S. Cl. ..... 446/354; 446/330; 40/419

[58] Field of Search ..... 446/354, 356, 365, 353, 446/352, 330, 338; 40/419, 414, 417, 418, 420, 411, 413

[56] References Cited

U.S. PATENT DOCUMENTS

| | | | |
|---|---|---|---|
| 1,482,820 | 2/1924 | Simonson | 40/419 |
| 1,690,811 | 11/1928 | Bartley | 446/354 |
| 2,140,056 | 12/1938 | Piro | 446/354 |
| 2,202,915 | 6/1940 | Maltese | 40/419 X |
| 2,820,323 | 1/1958 | Reiser | 446/353 X |
| 3,029,552 | 4/1962 | Katz | 446/353 |
| 3,705,726 | 12/1972 | Johmann | 446/354 X |
| 3,722,136 | 3/1973 | Thorn et al. | 446/354 |
| 3,851,418 | 12/1974 | Barlow et al. | 446/354 X |
| 3,995,394 | 12/1976 | Ayton | 446/326 |
| 4,003,158 | 1/1977 | Wolf et al. | 446/334 |
| 4,085,540 | 4/1978 | Jernstrom et al. | 446/333 |
| 4,231,184 | 11/1980 | Corris et al. | 446/175 |
| 4,244,141 | 1/1981 | Douglas et al. | 446/355 |
| 4,407,090 | 10/1983 | Pyo et al. | 446/184 |
| 4,422,261 | 12/1983 | Kozuka et al. | 446/290 |

FOREIGN PATENT DOCUMENTS

| | | | |
|---|---|---|---|
| 184673 | 9/1966 | Bulgaria | 446/352 |
| 624287 | 7/1927 | France | 446/330 |
| 476872 | 12/1952 | Italy | 446/353 |
| 56870 | of 1911 | United Kingdom | 446/356 |

*Primary Examiner*—Robert A. Hafer
*Assistant Examiner*—D. Neal Muir
*Attorney, Agent, or Firm*—Sherman and Shalloway

[57] ABSTRACT

A simple device to activate a decorative doll's limbs by means of simple linkages is driven by two motors. One motor is able to drive the doll's upper torso to swing and the other motor, located in the torso, is able to activate the doll's head and arm so as to magnify the doll's decorative effect.

5 Claims, 6 Drawing Sheets

FIG.7
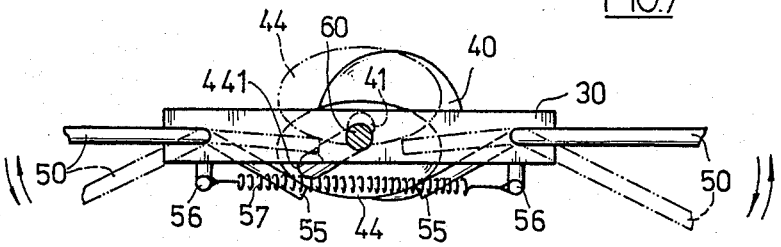
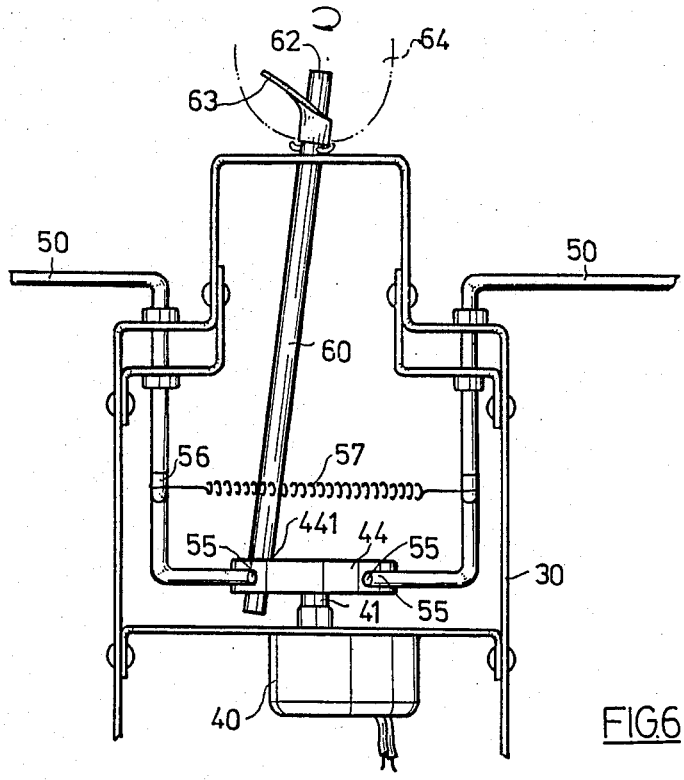
FIG.6

APPARATUS FOR ACTIVATING DOLL'S LIMBS

SUMMARY OF THE INVENTION

The present invention is directed to a simple, relatively quiet structure to activate the limbs of a decorative doll. Furthermore, the inventor has reviewed U.S. Pat. Nos. 4,407,090; 3,995,394; 4,003,158; 4,422,261; 4,085,540; and 4,231,184, etc. to make a comparison with this invention both in technology and progressiveness and has determined that designs of some of the patents are too complicated and lacking in design to activate the upper torso and to make a doll's head and/or arm move simultaneously.

The purpose of this invention as above-stated is to overcome the shortcoming of the conventional structures by means of applying a very simple structure to activate the decorative doll.

The secondary purpose of this invention is to provide a kind of driven device without much noise to eliminate the noise caused by the conventional structures and to make the decorative doll more beautiful as well as calm and tranquil.

An additional purpose of this invention is to provide a device to activate the doll's head and arm together with the upper torso to make the doll's decorative effect be lifelike.

BRIEF DESCRIPTION OF THE DRAWINGS

FIG. 6 is the front view of the third implementation instance of this invention.

FIG. 7 is a top view of the third implementation instance of this invention.

DETAILED DESCRIPTION OF THE INVENTION

INSTANCE I

Figure 1:
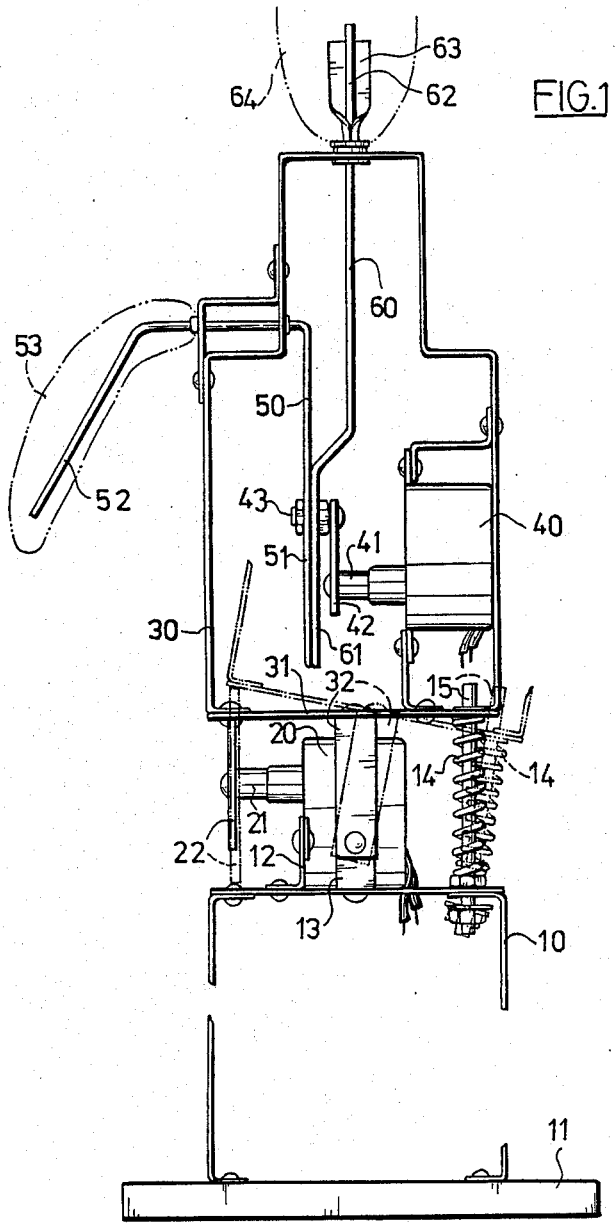
FIG. 1 is the front view of the first implementation instance of this invention.
Figure 2:
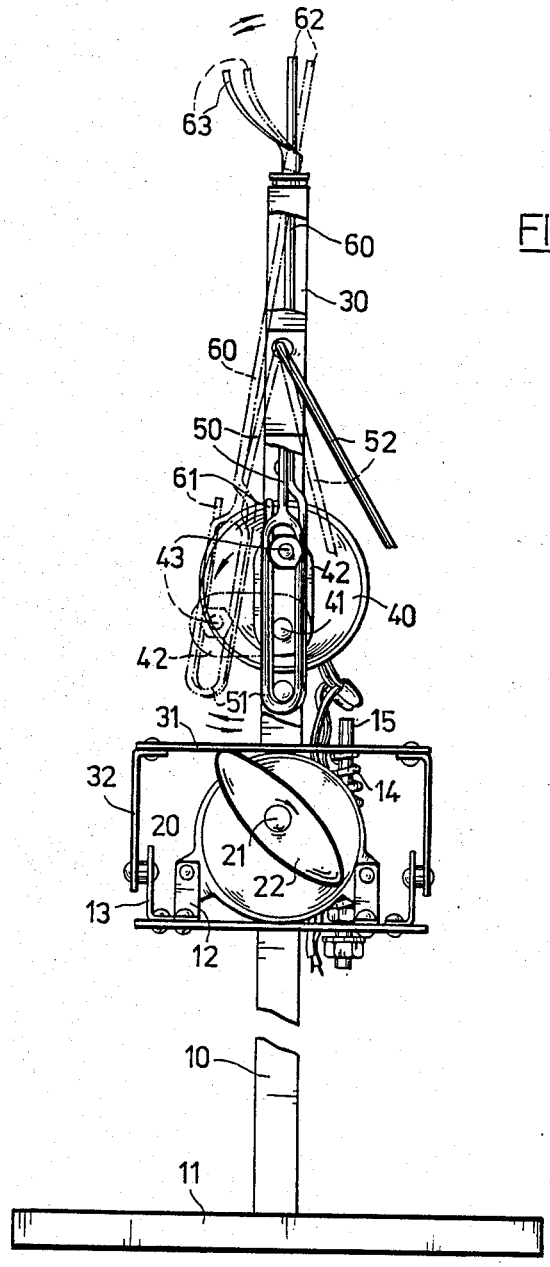
FIG. 2 is a side view of the first implementation instance of this invention.

As shown in FIGS. 1 and 2, a fixed support frame 10 with a base can be secured at the top of a stand 11. On the upper side of the support frame 10 there is at least one fastened piece 12 fixed on a motor 20 with the motor output shaft 21 appearing to be of level position and at the end of motor shaft 21 there is fastened a cam 22 which may also be of the shape of an eccentric wheel.

There is a moveable support frame 30 with a base 31 generally located on both flanks of the central position. There are a pair of stands 32 fastened on another pair of stands 13 fastened on both flanks of the fixed support frame 10. Therefore, the moveable support frame 30 may pivot to swing on the support frame 10, while being supported by the above-said cam 22 and a spring 14 on the back side of motor 20. There is a rod 15 pivoted on the top of support frame 10, pierced through the central part of spring 14 and emerging on the top of base 31 of the moveable support frame 30 to enable the spring 14 not to be bent as it is compressed.

When cam 22 or the like rotates to a position where the great radius of the wheel faces upward, it may jack up the base 31. As shown in the simulated line of FIG. 1, the moveable support frame 30 swings toward right and the spring 14 is compressed and when the cam 22 rotates to a position where the small radius of the wheel faces upard, the base 31 is pushed by the spring 14 and swings toward the left to resume the original position. As it swings to and fro, with the moveable support frame 30 connected with the doll's upper torso, it will enable the doll's upper torso to swing creating a decorative posture.

Another motor 40 is fastened on the above-mentioned moveable support frame 30 and the motor output shaft 41 is generally disposed in a level position. A rotating plate 42 is secured at the end of output shaft 41 and at the other end of rotating plate 42 is placed a short rod-shaped piece 43. The characteristic of drive piece 43 is generally parallel to but spaced from the axis of motor output shaft 41 so as to be an eccentric. There is a hand rod 50 pivoted on the flank of support frame 30 with a snap ring 51 at the lower end which is sleeved on the driven piece 43.

There is ahead rod 60 with a snap ring 61 also sleeved on the driven piece 43. Therefore, once the driven piece 43 rotates together with the rotating piece 42, it can push the hand rod 50 and head rod 60 to swing. Thus, if the three end 52 which is the portion the hand rod protruding from the support frame 30 is connected with the doll's arm 53, and a doll's head 64 with a head frame 63 is connected to the free end 62 which is the portion of the head rod 60 protruding from the support frame 30, the doll's arm 53 and head 64 will swing forward and backward, or up and down.

INSTANCE II

Figure 3:
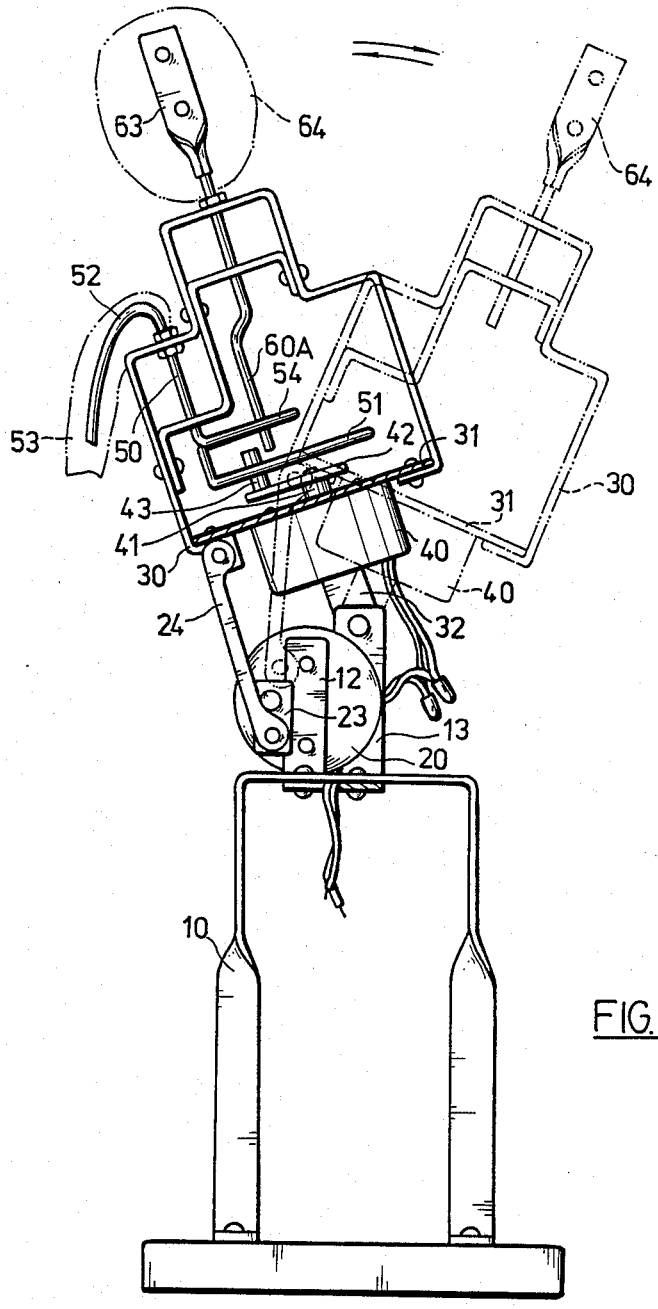
FIG. 3 is the front view of the second implementation instance of this invention.
Figure 4:
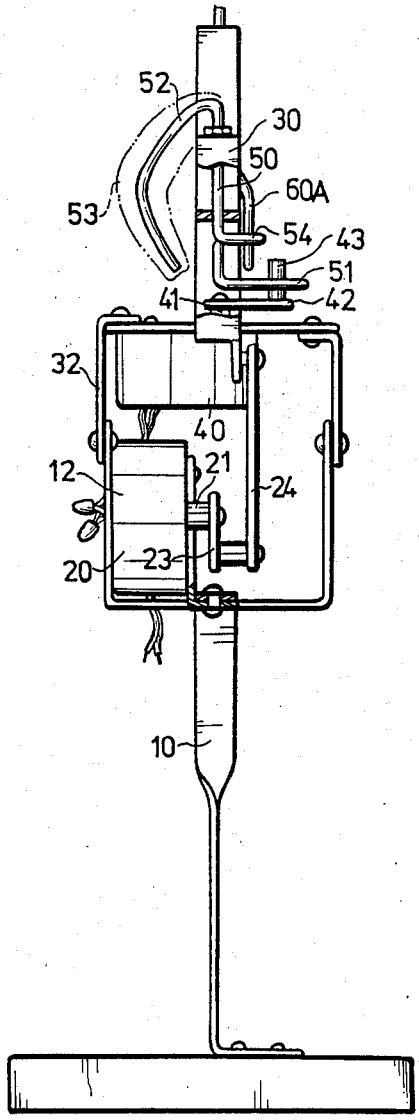
FIG. 4 is a side view of the second implementation instance of this invention.

As shown in FIGS. 3 and 4, there are support frame 10 and motor 20 the same as that of Instance I. However, the difference is that the shaft end of motor 20 is fastened to an end of rotating piece 23 with the other end pivoted to a push rod 24 to form a crank linkage. The upper end of the push rod 24 is pivoted at an appropriate position on the moveable support frame 30.

The base end of moveable support stand 30 generally is located on the both flanks of the central position. As shown in the Instance I, which is still installed with a pair of stands 32 so as to enable the moveable support frame 30 to pivot at the upper side of the support frame 10, and because of ascending and descending motion of the push rod 24 activating the moveable support frame, the doll's upper torso appears to be swinging.

A motor 40 is fixed inside the moveable support frame 30 and the axis of motor 40 is vertical with one end of motor shaft 41 secured to a rotating piece 42. The other end of the rotating piece 42 is fixed to a short rod-shaped piece 43. The characteristic of the foregoing structure is to maintain an appropriate distance between the piece 43 and the output shaft 41 of the motor 40 so as to become an eccentric. On at least one flank of the moveable support frame 30 is pivoted a hand rod 50 and a snap ring 51 which, positioned at the lower end of the hand rod 50, is sleeved on the driven piece 43. The free end 52 which is the upper portion of the hand rod 50 protruding from the moveable support frame 30 is connected with the doll's arm 53. When the piece 43 rotates around the motor shaft 41, it can push the snap ring 51 reciprocally to make the hand rod free end 52 activate doll's arm 53 to swing forward and backward.

Figure 5A:
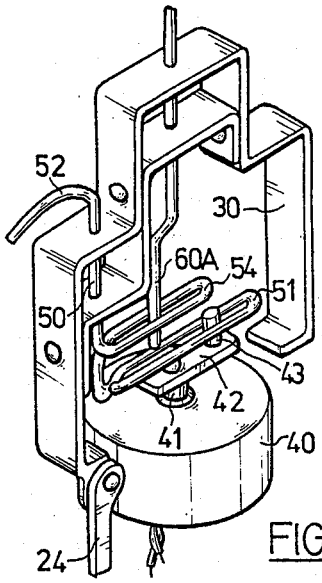
FIG. 5A is a perspective view of the second implementation instance of this invention.
Figure 5B:
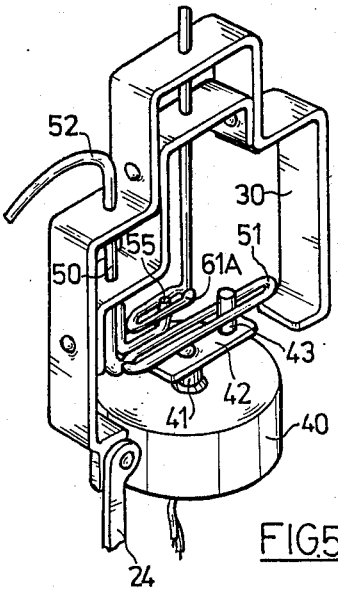
FIG. 5B is a perspective view of a variation of the second implementation instance of this invention.

Applying tne swinging of the hand rod 50 to the upper side of hand rod 50 as shown in FIG. 5A, another snap ring 54 may connect the base end of the -shaped head rod 60A. The equivalent effect is applied as shown in FIG. 5B, that is to design the snap ring 54 of hand rod 50 to be a short rod 55 and to make the base end of ㄴ-shaped head rod 60A equip a snap ring 61A. The upper portion of the head rod 60A is pivoted upon the moveable support frame 30. And there is a head frame 63 to connect with the doll's head 64. While the hand rod 50 is swinging, head rod 60A can also be activated to swing on the support frame 30.

The way to make the moveable support frame 30 swing on the support frame 10 in this Instance can also use the structure of Instance I. Similarly, some preferred implementation instances recommended hereinafter may also apply to Instance I or the structure of this Instance II.

INSTANCE III

Inside the moveable support frame 30, as in the method shown in the Instance II, a motor 40 is installed and at the shaft end of motor is placed a cam 44 or other equivalent eccentric wheel. The hand rods 50 on both flanks of the support frame 30 have ends 55 close by the face of cam 44. The structure of hand rod 50 is the same as that of the Instance I and II: A hook end 56 is installed at the appropriate position of the hand rods 50 to hook up a spring 57 therebetween. Thus, when motor 40 rotates the large radius of cam 44 presses the end 55 of hand rod 50 to make the hand rod swing. Hereafter, the cam's small radius will contact the end 55 by means of the pressure applied by spring 57 to make the hand rod 50 swing back to the original position. Thus, the doll's arm 53 can swing reciprocally. Of course, the shape of spring 57 can even be that of a volute spring which can also attain the equivalent result.

A hole 441 may be formed in the cam 44 at an appropriate distance from shaft 41 of the motor 40 to form an eccentric. The lower end of head rod 60 is pivoted on the upper end of moveable support frame 30 and the lower end is sleeved in the hole 441 of cam 44. When cam 44 rotates, the head rod 60 will take moveable support frame 30 as a supporting point (fulcrum) to rotate along a conical track, so tht the head frame 63 of the upper end of head rod 60 will activate the doll's head 64 to rotate.

INSTANCE IV

Figure 8:
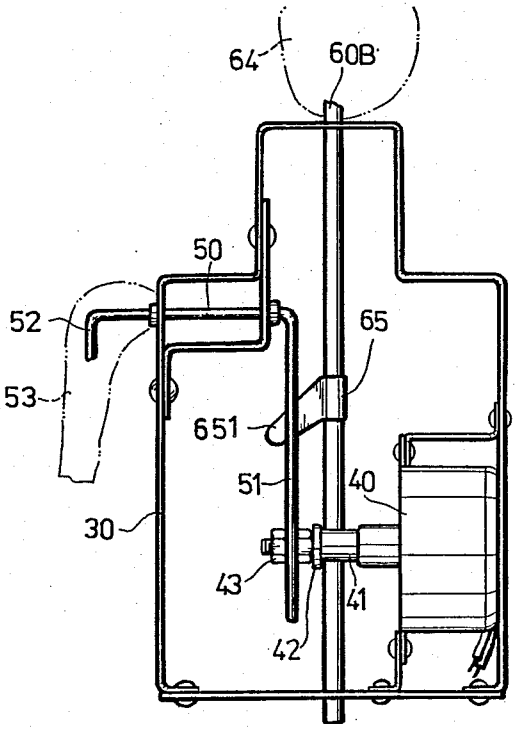
FIG. 8 is a front view of the fourth implementation instance of this invention.
Figure 9:
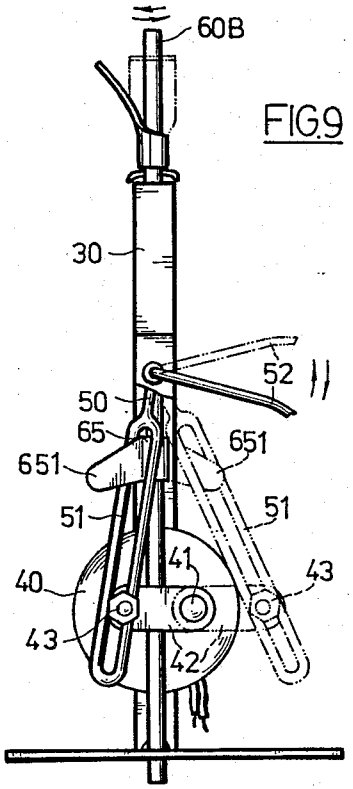
FIG. 9 is a side view of the fourth implementation instance of this invention.

Except for the method of rotating the head rod as shown in FIGS. 8 and 9, the previously disclosed structures may be utilized, i.e. pivot the head rod 60B on the moveable support frame 30 with both the upper and lower ends and fasten a swing piece 65 at the middle portion. While the free end 651 of swing piece 65 is sleeved into the snap ring 51 of hand rod 50, because the structure of hand rod 50 is the same as that of Instance I, the head rod 60B can be driven by the motor 40 and swing forward and backward, or up and down. Due to the foregoing swinging linking the free end 651 of swing piece 65, the head rod 60B is allowed to swing within certain limits. This is also a very simple structure to activate the arm 53 and head 64.

To sum up the above structure set forth in Instance I–IV, two major methods of permitting the doll's upper torso to swing can combine with several methods to drive the doll's hand and/or head. Each of these combinations can achieve the purpose of enhancing the decorative effect of torso movement without much noise generation by way of using these simple structures. While the invention has been described with reference to details of the illustrated embodiment, such details are not intended to limit the invention as defined in the appended claims.

I claim:

1. An apparatus for activating a doll's head, limbs and torso comprising:

a fixed support frame for supporting said doll's torso;

a moveable support frame for supporting said doll's upper torso;

connection means, having a first substantially horizontal pivot axis, but pivotally connecting said fixed support frame to said moveable support frame for pivotal movement of said moveable support frame about said first pivot axis relative to said fixed support frame between a first torso position and a second torso position;

first activating means, mounted on said fixed support frame, for moving said moveable support frame between said first torso position and said second torso position;

arm support means, pivotally mounted in said moveable support frame, for supporting an arm of said doll for pivotal movement about a second pivot axis relative to said moveable support frame between a first arm position and a second arm position;

head support means, movably mounted in said moveable support frame, for supporting the head of said doll for movement relative to said moveable support frame between a first head position and a second head position;

second activating means, mounted on said moveable support frame and operably connected to said arm support means and said head support means, for moving said arm support means between said first arm position and said second arm position and for moving said head support means between said first head position and said second head position;

said second activating means comprising:

a second motor having a rotatable shaft, said rotatable shaft having a substantially horizontal axis of rotation;

a third link member having a first end and a second end, said first end of said third link member fixedly connected to said rotatable shaft of said second motor for rotation therewith;

a pin member fixed to said second end of said third link and extending substantially parallel to said shaft axis; and wherein said head support means comprises:

a first elongate member, having a first end and a second end, mounted in said moveable support frame for pivotal movement about a pivot axis substantially parallel to said shaft axis, said first end of said first elongate member adapted to receive said doll's head thereupon, said second end of said first elongate member formed as a slot slidingly receiving said pin member;

and wherein said arm support means comprises:

a second elongate member, having a first end and a second end, mounted in said moveable support frame for pivotal movement about a pivot axis substantially parallel to said shaft axis, said first end of said second elongate member adapted to receive a doll's arm thereon, said second end of said second elongate member formed as a substantially vertical slot slidingly receiving said pin member.

2. An apparatus for activating a doll's head, limbs and torso comprising:

a fixed support frame for supporting said doll's torso;

a moveable support frame for supporting said doll's upper torso;

connection means, having a first substantially horizontal pivot axis, for pivotally connecting said fixed support frame to said moveable support frame for pivotal movement of said moveable support frame about said first pivot axis relative to said fixed support frame between a first torso position and a second torso position;

first activating means, mounted on said fixed support frame, for moving said moveable support frame between said first torso position and said second torso position;

arm support means, pivotally mounted on said moveable support frame, for supporting an arm of said doll for pivotal movement about a second pivot axis relative to said moveable support frame between a first arm position and a second arm position;

head support means, movably mounted in said moveable support frame, for supporting the head of said doll for movement relative to said moveable support frame between a first head position and a second head position;

second activating means, mounted on said moveable support frame and operably connected to said arm support means and said head support means, for moving said arm support means between said first arm position and said second arm position and for moving said head support means between said first head position and said second head position;

said second activating means comprising:

a second motor having a rotatable shaft, said rotatable shaft having a substantially vertical axis of rotation;

a third link member having a first end and a second end, said first end of said third link member fixedly connected to said rotatable shaft of said second motor for rotation therewith;

a pin member fixed to said second end of said third link member and extending substantially parallel to said shaft axis;

and wherein said head support means comprises:

a crank-like member comprising a vertically upwardly extending member, a vertically downwardly extending member displaced horizontally from said vertically upwardly extending member and a substantially horizontal member conjoining said vertical upwardly extending member and said vertically downwardly extending member, said vertically upwardly extending member being adapted to support a doll's head on an upper end thereof, said vertically upwardly extending member rotatably supported in said moveable support frame for rotation about a substantially vertical axis;

and wherein said arm support means comprises:

a second vertically upwardly extending member, said second vertically upwardly extending member being adapted to support a doll's arm on an upper end thereof, said second vertically upwardly extending member rotatably supported in said moveable support frame for rotation about a substantially vertical axis;

a lower slot element affixed to and extending substantially perpendicular to said second vertically upwardly extending member and slidingly receiving said pin member therein;

an upper slot element affixed to and extending substantially perpendicular to said second vertically upwardly extending member and slidingly receiving said vertically downwardly extending member therein, said upper slot element being vertically upwardly displaced from said lower slot element.

3. An apparatus for activating a doll's head, limbs and torso comprising:

a fixed support frame for supporting said doll's torso;

a moveable support frame for supporting said doll's upper torso;

connection means, having a first substantially horizontal pivot axis, for pivotally connecting said fixed support frame to said moveable support frame for pivotal movement of said moveable support frame about said first pivot axis relative to said fixed support frame between a first torso position and a second torso position;

first activating means, mounted on said fixed support frame, for moving said moveable support frame between said first torso position and said second torso position;

arm support means, pivotally mounted in said moveable support frame, for supporting an arm of said doll for pivotal movement about a second pivot axis relative to said moveable support frame between a first arm position and a second arm position;

head support means, movably mounted in said moveable support frame, for supporting the head of said doll for movement relative to said moveable support frame between a first head position and a second head position;

second activating means, mounted on said moveable support frame and operably connected to said arm support means and said head support means, for moving said arm support means between said first arm position and said second arm position and for moving said head support means between said first head position said second head position;

said second activating means comprising:

a second motor having a rotatable shaft, said rotatable shaft having a substantially vertical axis of rotation;

a third link member having a first end and a second end, said first end of said third link member fixedly connected to said rotatable shaft of said second motor for rotation therewith;

a first pin member fixed to said second end of said third link member and extending substantially parallel to said shaft axis;

and wherein said head support means comprises:

a first vertically upwardly extending member, said first vertically upwardly extending member being adapted to support a doll's head on an upper end thereof, said first vertically upwardly extending member rotatably supported in said moveable support frame for rotation about a substantially vertical axis;

a first slot element affixed to a lower end of said first vertically upwardly extending member and extending substantially perpendicular thereto;

and wherein said arm support means comprises:

a second vertically upwardly extending member, said second vertically upwardly extending member being adapted to support a doll's arm on an upper end thereof, said second vertically upwardly extending member rotatably supported in said moveable support frame for rotation about a substantially vertical axis;

a second slot element affixed to a lower end of said second vertically upwardly extending member and extending substantially perpendicular thereto, said second slot element slidingly receiving said first pin member therein;

a second pin member affixed to said second slot element and extending upwardly substantially parallel to said first pin member, said second pin member slidingly received within said first slot element.

4. An apparatus for activating a doll's head, limbs and torso comprising:

a fixed support frame for supporting said doll's torso;

a moveable support frame for supporting said doll's upper torso;

connection means, having a first substantially horizontal pivot axis, for pivotally connecting said fixed support frame to said moveable support frame for pivotal movement of said moveable support frame about said first pivot axis relative to said fixed support frame between a first torso position and a second torso position;

first activating means, mounted on said fixed support frame, for moving said moveable support frame between said first torso position and said second torso position;

arm support means, pivotally mounted in said moveable support frame, for supporting an arm of said doll for pivotal movement about a second pivot axis relative to said moveable support frame between a first arm position and a second arm position;

head support means, movably mounted in said moveable support frame, for supporting the head of said doll for movement relative to said moveable support frame between a first head position and a second head position;

second activating means, mounted on said moveable support frame and operably connected to said arm support means and said head support means, for moving said arm support means between said first arm position and said second arm position and for moving said head support means between said first head position and said second head position;

said second activating means comprising:

a second motor having a rotatable shaft, said rotatable shaft having a substantially vertical axis of rotation;

a cam member mounted on said rotatable shaft for rotation therewith, said cam member having a cam surface, said cam member having a hole therethrough, said hole displaced from said axis of rotation;

and wherein said head support means comprises:

a first vertically upwardly extending member, said first vertically upwardly extending member being adapted to support a doll's head on an upper end thereof, said first vertically upwardly extending member supported in said moveable support frame for movement in a conical track, a lower end of said vertically upwardly extending member being slidingly receivable in said hole in said cam;

and wherein said arm support means comprises:

a second vertically upwardly extending member, said second vertically upwardly extending member, said second vertically upwardly extending member being adapted to support a doll's arm on an upper end thereof, said second vertically upwardly extending member rotatably supported in said moveable support frame for rotation about a substantially vertical axis;

a cam engaging element affixed to a lower end of said second vertically upwardly extending member and extending substantially perpendicular thereto, a free end of said cam engaging element slidingly contactable of said cam surface;

spring means for yieldably urging said free end of said cam engaging element into contact with said cam surface.

5. An apparatus for activating a doll's head, limbs and torso comprising:

a fixed support frame for supporting said doll's torso;

a moveable support frame for supporting said doll's upper torso;

connection means, having a first substantially horizontal pivot axis, for pivotally connecting said fixed support frame to said moveable support frame for pivotal movement of said moveable support frame about said first pivot axis relative to said fixed support frame between a first torso position and a second torso position;

first activating means, mounted on said fixed support frame, for moving said moveable support frame between said first torso position and said second torso position;

arm support means, pivotally mounted on said moveable support frame, for supporting an arm of said doll for pivotal movement about a second pivot axis relative to said moveable support frame between a first arm position and a second arm position;

head support means, movably mounted in said moveable support frame, for supporting the head of said doll for movement relative to said movement support frame between a first head position and a second head position;

second activating means, mounted on said moveable support frame and operably connected to said arm support means and said head support means, for moving said arm support means between said first arm position and said second arm position and for moving said head support means between said first head position and said second head position;

said second activating means comprising:

a second motor having a rotatable shaft, said rotatable shaft having a substantially horizontal axis of rotation;

a third link member having a first end and a second end, said first end of said third link member fixedly connected to said rotatable shaft of said second motor for rotation therewith;

a first pin member fixed to said second end of said third link member and extending substantially parallel to said shaft axis;

and wherein said head support means comprises:

a first vertically upwardly extending member, said first vertically upwardly extending member being adapted to support a doll's head on an upper end thereof, said first vertically upwardly extending member rotatably supported in said moveable support frame for rotation about a substantially vertical axis;

a swing piece, having a free end, affixed to said first vertically upwardly extending member for rotation therewith; and wherein said arm support means comprises:

an elongate member, having a first end and has a second end, mounted in said moveable support frame for pivotal movement about a substantially horizontal pivot axis, said first end of said elongate member adapted to receive a doll's arm thereon, said second end of said elongate member formed as a substantially vertical slot, said slot having a first portion and a second portion, said first portion slidingly receiving said first pin member, said second portion receivingly engaging said free end of said swing piece.

* * * * *